US006125670A

United States Patent [19]

Fuss et al.

[11] Patent Number: 6,125,670

[45] Date of Patent: Oct. 3, 2000

[54] SELF-LOCKING LOCK

[75] Inventors: Fritz Helmut Fuss; Gerhard Gonser, both of Albstadt, Germany

[73] Assignee: eff-eff Fritz Fuss GmbH & Co., Kommanditgesellschaft auf Aktien, Albstadt-Ebingen, Germany

[21] Appl. No.: 09/009,330

[22] Filed: Jan. 20, 1998

[30] Foreign Application Priority Data

Jan. 20, 1997 [DE] Germany ..... 197 01 761

[51] Int. Cl.[7] ..... E05B 59/00

[52] U.S. Cl. ..... 70/107; 70/110

[58] Field of Search ..... 70/107, 109, 110, 70/116, 118, 120, 134, 141, 150

[56] References Cited

U.S. PATENT DOCUMENTS

| | | | |
|---|---|---|---|
| 3,881,331 | 5/1975 | Tranberg et al. | 70/107 |
| 4,583,382 | 4/1986 | Hull | 70/107 |
| 4,950,005 | 8/1990 | Cudd | 70/107 |
| 5,044,184 | 9/1991 | Herbert et al. | 70/107 |
| 5,083,448 | 1/1992 | Kärkkäinen et al. | 70/107 |
| 5,265,920 | 11/1993 | Kaup et al. | 70/107 |

FOREIGN PATENT DOCUMENTS

| | | | |
|---|---|---|---|
| 378124 | 7/1990 | European Pat. Off. | 70/107 |

*Primary Examiner*—Teri Pham

*Attorney, Agent, or Firm*—Oblon, Spivak, McClelland, Maier & Neustadt, P.C.

[57] ABSTRACT

A self-locking lock with a bolt, a lock swing catch and an auxiliary swing catch, in which the bolt and lock swing catch move out in a locking position in spring-loaded manner with the door closed and move out in a locking position are lockable by a slide plate, while the auxiliary swing catch pressed on a locking plate and in which the bolt, with the door open, is held back in the lock housing and is arrestable by the auxiliary swing catch by means of the slide plate. In order to provide a lock secure against manipulation and reliable in operation, where an uncontrollable extension of the bolt is particularly effectively prevented even in intermediate states of the opening and closing process, on opening the bolt leads compared with the lock swing catch and is arrestable completely retracted in the lock and the lock swing catch is provided with a widening, e.g., with a pivotable, springloaded swing catch part. As a result the lock swing catch engages longer on the locking plate and lags behind the auxiliary swing catch, so that the slide plate and bolt are arrested until the auxiliary swing catch arrests the slide plate and bolt. The lock swing catch widening has no effect on closing.

11 Claims, 5 Drawing Sheets

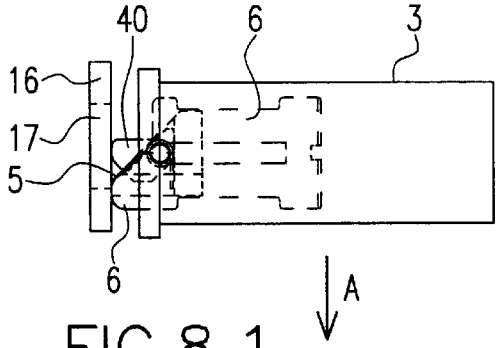
FIG.8.1
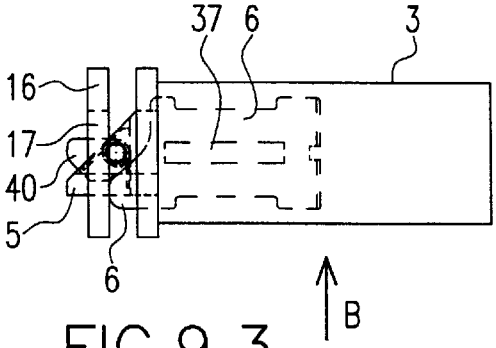
FIG.9.3
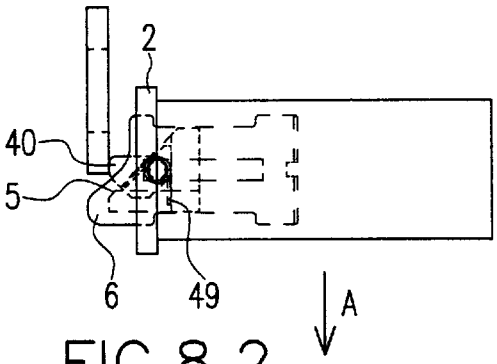
FIG.8.2
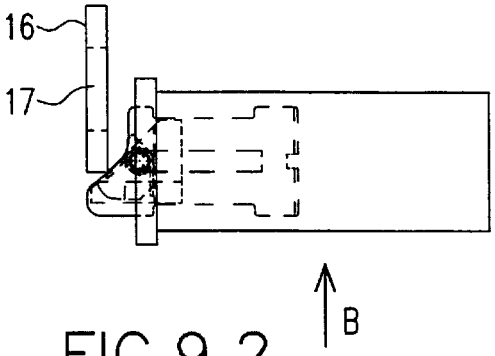
FIG.9.2
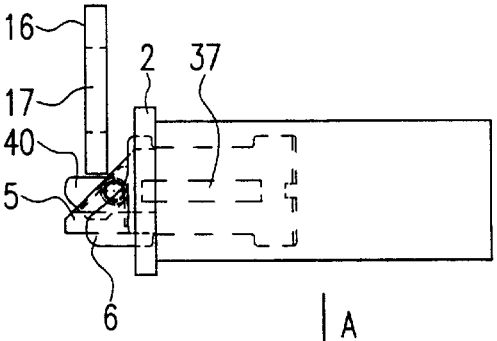
FIG.8.3
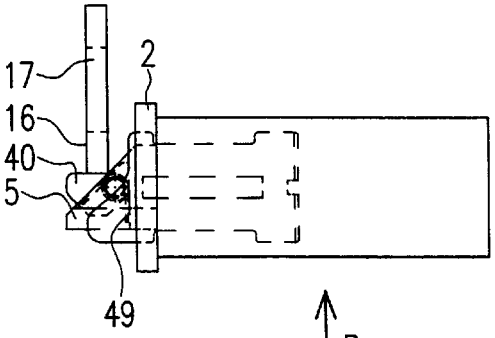
FIG.9.1

SELF-LOCKING LOCK

BACKGROUND OF THE INVENTION

1. Field of the Invention

The present application is based upon German patent application no. 197 01 761.4, filed on Jan. 20, 1997, which is hereby incorporated by reference. The invention relates to a self-locking lock with a bolt, a lock swing catch, an auxiliary swing catch and a slide plate, in which the bolt and the lock swing catch move outwardly into a locking position due to a spring-load and are locked with the door closed, and in which the bolt in the case of the open door and in the completely retracted position is arrested by the auxiliary swing catch via the slide plate, and by pressing in the auxiliary swing catch on closing the door, the arresting of the bolt is cancelled and the bolt moves out into a locking position.

2. Discussion of the Related Art

DE 44 07 244 C1 describes a self-locking lock with a changer, a bolt-movable into the closed position by a spring, a swing catch and an auxiliary swing catch, in which the bolt operable by means of a split latch nut or a lock cylinder can be arrested in the open position by means of a catch releasable by means of the auxiliary swing catch. An unintended extension of the bolt with the door open is prevented in that a second pivoted lever, controlled by the swing catch, is provided for blocking the auxiliary swing catch, and the latter is blocked in the extended position by the pivoted lever when the swing catch is also extended.

Although this lock has proven satisfactory in practice, it can occur that in intermediate states the bolt is extended but does not pass into the opening of the locking plate. This can, e.g., arise due to a springing back of the door in the case of an uncontrolled closure onto excessively strong door seals. It is also not completely possible to exclude problems if, in the case of an authorized door opening from the outside, the door handle does not remain pressed down to the complete opening of the door and the bolt moves forward again without being able to engage in the locking plate.

In the case of a self-locking door lock described in EP 668 425 A1, a bolt is guided in a guide link of a push rod, the latter being displaceable linearly against the tension of a biasing spring and the bolt is drawn into the lock. A safety catch which, e.g., has a catch rod located on the push rod and a tiltably mounted catch plate, engages in such a manner on the push rod that the bolt is arrested in each withdrawn position. With the aid of a position sensor projecting out of the door lock it is possible to release the safety catch and, under the action of the biasing spring which acts on the push rod, the bolt can move out into a locking position.

This known lock is particularly intended for burglar-proof locks with several blocked bolts. The linear push movement is used as a particularly easy transfer for the secondary locks. However, the bolt is arrestable in the end portion of its withdrawal movement in each withdrawal position, so that the bolt is not completely retracted into the lock box, and so the door can only be opened in the case of a wide air gap between frame and door.

SUMMARY OF THE INVENTION

Accordingly, one object of this invention is to provide a self-locking lock which is secure against manipulation and reliable in operation, in which an uncontrolled extension of the bolt in each phase of the opening and closing process is prevented in a particularly effective and constructionally very efficient manner.

According to the invention this object is achieved in that on opening the door the bolt leads as compared with the lock swing catch, and that the lock swing catch is provided with a swing catch part and consequently lags behind the auxiliary swing catch Thus the slide plate and bolt are arrested by the lock swing catch until the auxiliary swing catch arrests the slide plate, and consequently the bolt and that the swing catch part are received on closure in the lock swing catch and that the lock swing catch when moved out in a locking position is locked by the slide plate.

A fundamental idea of the invention is that the mechanism of a lock for the cooperation of bolt, lock swing catch and auxiliary or control swing catch be so constructed that, on opening, the bolt is moved in "leading" manner with respect to the lock swing catch. The bolt is always completely retracted into the lock and is arrested in the completely retracted state. A slide plate is resiliently biased and locks the bolt and the lock swing catch against pressing back into the lock when moved out in a locking position and in the case of an open door. It retains the bolt in the lock by means of the auxiliary swing catch, which blocks a catch lever and consequently prevents an unintentional release of the lock. It is elongated and preferably vertically movable and has a guide link for an, e.g., 90%, deflected movement of a locking bolt.

In addition, the slide plate is constructed in such a way that it is held by a swing catch bushing or roller located on the lock swing catch if, on opening the door, the lock swing catch slides into a so-called intermediate state on the front of the counterpart or locking plate. As the slide plate is held by the lock swing catch roller, the bolt is reliably held in a trouble-free manner in its retracted position.

According to the invention, the arresting of the slide plate by the lock swing catch roller in an intermediate state on opening the door and a retention of the bolt in this intermediate state in a manipulation-safe and operationally reliable manner is achieved by a specific construction of the lock swing catch and its arrangement with respect to the auxiliary or control swing catch.

According to the invention, use is made of a lock swing catch which widens or expands in a predeterminable intermediate state. The catch part can, e.g., be multipart and in particular a two-part construction. Preferably the lock swing catch has at least one swing catch part which is arranged in an adjustable and counterloaded manner on the lock swing catch in such a way that in the unloaded state and on viewing from the face plate, an opening is held in a position widening the lock swing catch and consequently engages longer on the locking plate.

On opening the door, e.g., by operating a latch from the inside of the door, in the case of authorized access by latch operation from the outside or in the case of authorized access using a key by operating a profile cylinder, as a result of the lock swing catch construction according to the invention, if the door is only somewhat open and the door latch has been released again, due to its width the lock swing catch only moves out in a locking position up to the surface of the counterpart or locking plate. As a result, the slide plate is held by the roller located on the lock swing catch in a predeterminable position, so that the bolt is held back in the lock. An uncontrollable moving out of the bolt to a locking position is not possible due to the slide plate being arrested in this position.

If the door is further opened, the auxiliary swing catch moves up to the counterpart, so that a nose provided on the slide plate in the vicinity of the auxiliary swing catch engages with the latter, so that the entire slide plate is prevented from further vertical downward movement Thus, the bolt remains in the retracted position in the lock. On further opening of the door the lock swing catch is also extended. As the auxiliary swing catch is still blocked, e.g., by a catch lever, the bolt can not be unintentionally released.

On closing the door, the lock swing catch initially passes with the pivotable swing catch part onto an edge of the locking plate. The swing catch part is so counterloaded, e.g., by a spring clip, that it is pressed back or pivoted into the lock swing catch The auxiliary swing catch, which appropriately has the same bevel or wedge-shaped construction as the lock swing catch and the swing catch part, engages with the edge of the locking plate and by means of a catch lever releases the slide plate from the stop position. However, by means of a cam on the slide plate it engages with the lock swing catch roller and is therefore prevented from further vertical movement until the lock swing catch can move forward in a locking position in the corresponding opening of the locking plate. Only then can the slide plate be moved and the bolt can move forward into a locking position by means of the guide link and a locking bolt guided therein, so that the basic position is reached with closed door and bolt and lock swing catch moved out in a locking position, as well as auxiliary or control swing catch pressed onto the locking plate.

A particularly advantageously constructed lock swing catch, with widening, cooperating with the auxiliary swing catch and slide plate will be explained hereinafter in conjunction with the description of the drawings.

The slide plate is guided on an inner surface of the face plate. In the vicinity of the auxiliary swing catch the slide plate has a slot guide, in which is placed a bolt on the casing side for the catch lever of the auxiliary swing catch. The slide is guided in a recess of the auxiliary swing catch and arrestable thereon by means of a detent. In the vicinity of the lock swing catch and the swing catch bushing or roller arranged on the latter the slide plate is provided with a preferably arcuate recess which receives the roller when bolt and lock swing catch are retracted for door opening purposes, i.e., received in the lock housing.

The lock swing catch can be moved by means of a swing catch lever and a per se known lever bar, which is in operative connection directly or indirectly with the slide plate and adjusts it vertically against the tension of a tension spring.

The self-locking lock can also be opened by means of a key and a cylinder block and changer. The cylinder toe, e.g., engages with a recess of the slide plate for the operation of the bolt and with a changer, which retracts the swing catch into the lock housing.

Essential advantages of the lock according to the invention are extremely high security against manipulations and interference in critical intermediate positions or actions and simultaneously a particularly efficient, space-saving mechanism ensuring the moving out in a locking position of the bolt for self-locking locks required by insurance regulations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 9.1 to 9.3 are plan views of a lock according to FIG. 7, showing the lock swing catch and auxiliary swing catch on closing the door;

DESCRIPTION OF THE PREFERRED EMBODIMENT

Figure 1:
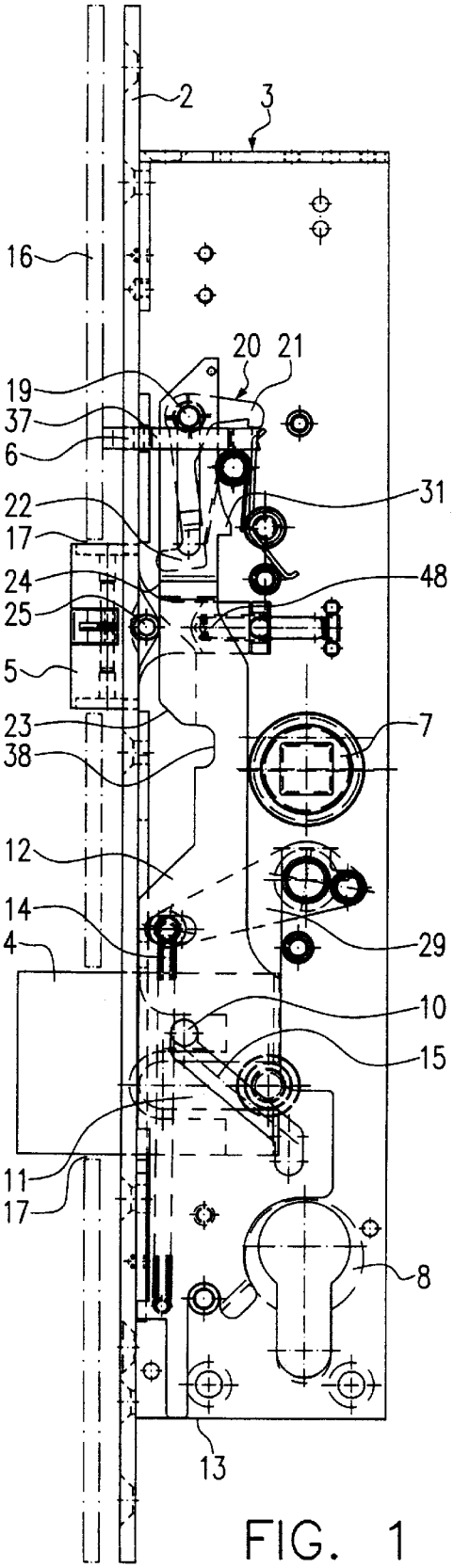
FIGS. 1 through 6 are cross-sections through a lock according to the invention during different lock operation phases.

Referring now to the drawings, wherein like reference numerals designate identical or corresponding parts throughout the several views, and more particularly to FIGS. 1 to 7, a lock according to the invention has a face plate 2, and a housing 3 in which are adjustably arranged a bolt 4, a lock swing catch 5 and an auxiliary or control swing catch 6. The lock is operable by means of a two-part inner/outer latch nut 7 and a key-operated lock cylinder 8 with a locking nose.

Insurance regulations require that the bolt 4 move outwardly by at least 20 mm into a locking position. The bolt 4 is guided within a recess by a locking bolt 10. The bolt 4 is horizontally moved by vertical movement of a slide plate 12 against a tension spring 14. The slide plate 12 extends from the lower housing edge 13 to beyond the auxiliary swing catch 6 and has a link-like guide 15 which guides a locking bolt 10 of the bolt 4 to cause horizontal bolt movement.

In FIG. 1 the lock is in its basic "door close" position in which the bolt 4 and the lock swing catch 5 above it are in their forward locking positions in openings 17 of the locking plate 16 of the door frame. The auxiliary swing catch 6, which is positioned above the lock swing catch 5, is slid back and presses on the locking plate 16.

In the vicinity of the auxiliary swing catch 6 the slide plate 12 is provided with a vertical slot 18 and moves within a recess 37 of the auxiliary swing catch 6. A bolt 19 is mounted in the slot opening 18. The bolt 19 forms the pivot pin for a substantially L-shaped catch lever 20 whose lower lever arm 22 can be brought into operative connection with the lock swing catch 5 by its upper lever arm 21 for arresting the auxiliary swing catch 6. In the vicinity of the lock swing catch 5, the slide plate 12 has a recess 38 which is separated via a bevel 23 from a substantially vertical control edge 24. In the basic position of FIG. 1, the control edge 24 engages a roller or catch bushing 25 of the lock swing catch 5 and locks the latter in its locking position. The advancement of the bolt 4 to its locking position is carried out by the lowering of the link guide 15, which extends at an angle of about 45° to the vertical. The locking bolt 10 is then held in its end position.

On operating the door lock by means of the latch nut 7, a transport lever 29 is pivoted by means of a per se known, not shown, mechanism. The transport lever 29 is connected to the slide plate 12 and vertically moves the latter. Both the lock swing catch 5 and auxiliary swing catch 6 are spring-biased in the direction of the locking position. The lock swing catch 5 is retracted by a (not shown) mechanism by means of a swing catch lever 30, which is pivotably mounted about a housing-side bolt 35 (FIGS. 2 and 5) on operating the latch nut 7.

Figure 2:
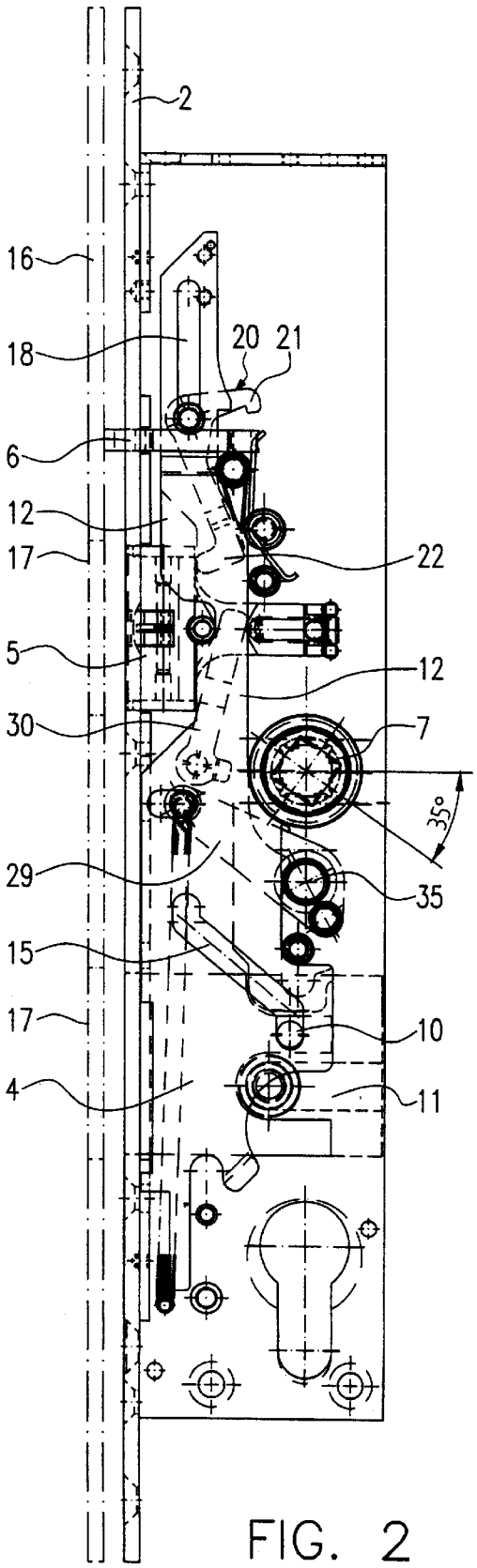

FIG. 2 shows the lock during operation from the inside, i.e., in panic function. Identical features are given identical reference numerals. Components not contributing to the understanding of the invention have been omitted and this also applies for the other drawings.

On operating the latch nut 7 by a door latch on the inside and rotation by approximately 35°, the bolt 4 and the lock swing catch 5 are retracted, the bolt 4 leading compared with the catch 5. The retraction of bolt 4 and lock swing catch 5 is done by means of the not shown mechanism, the transport lever 29 and the slide plate 12 or swing catch lever 30. The door can then be opened. If the door is not opened and the door latch nut 7 is released, the bolt 4 and lock swing catch 5 again move forward in a locking position and close the door (FIG. 1).

Figure 3:
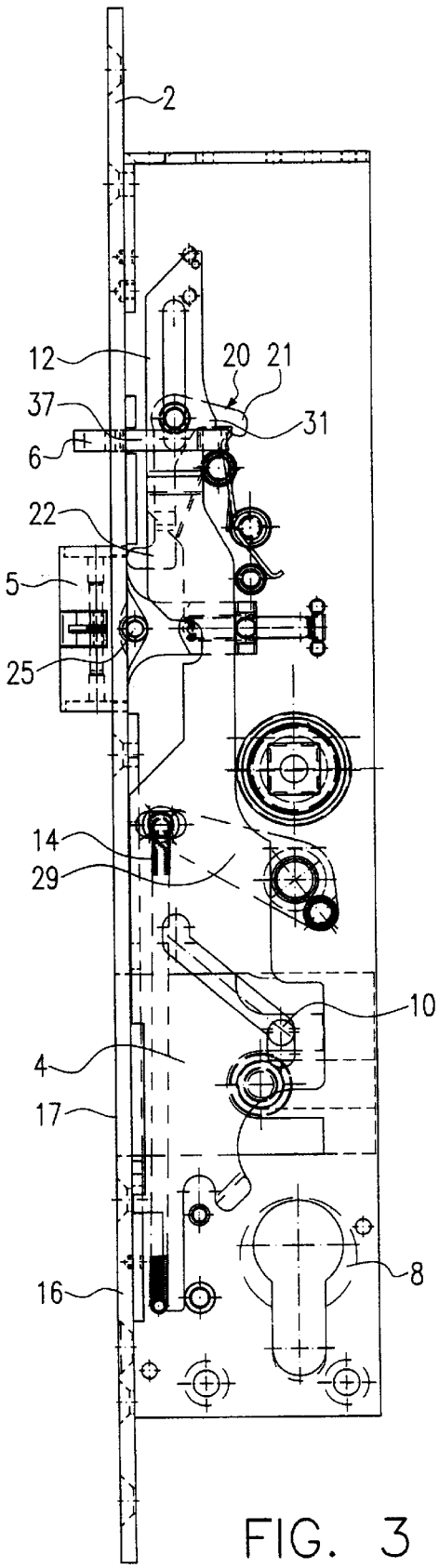

FIG. 3 shows the lock with the door open, in which the auxiliary swing catch 6 and lock swing catch 5 project from the face plate 2 and the bolt 4 is retained in the lock and secured against unintentional advance. This securing is provided by the auxiliary swing catch 6 which is blocked by the upper level arm 21 of the catch lever 20 and arrests the slide plate by means of a detent 31. Through a relative movement of the lock swing catch 5 and auxiliary swing catch 6, the latter is unlocked by means of the catch lever 20 and as a result of the downwardly moved side plate 12 on closing the door, the bolt 4 can close in a spring-loaded, self-locking manner.

Figure 4:
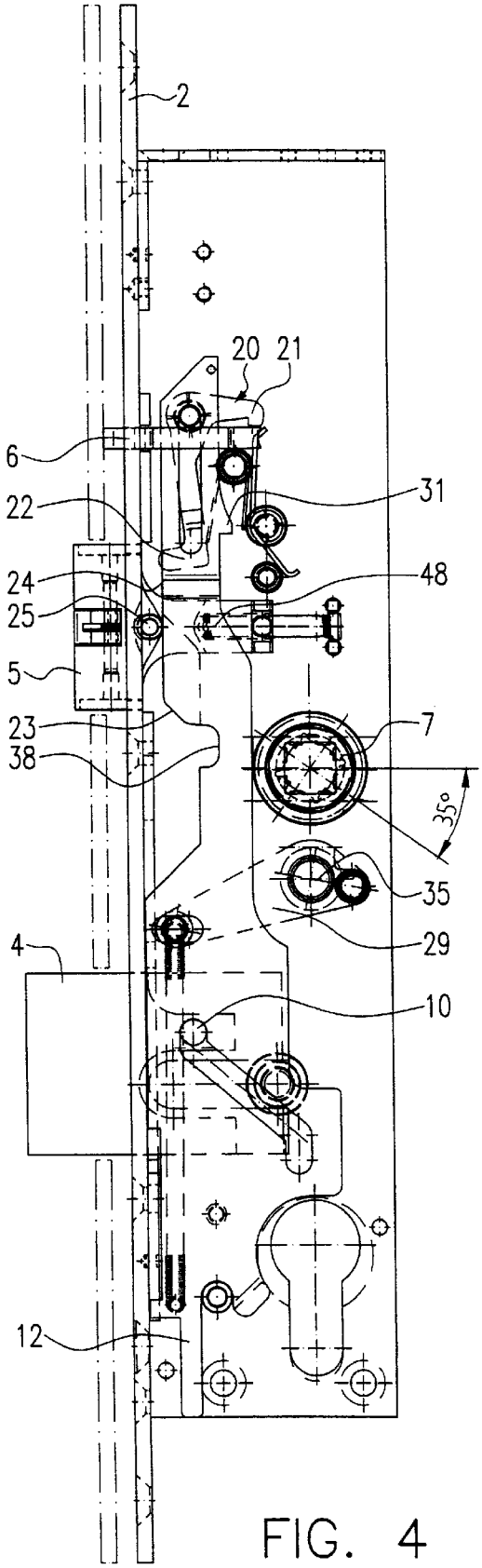

FIG. 4 shows an operation from the outside with the door closed. If authorized access does not exist, the door or latch nut 7 freewheels for outside inputs up to approximately 35°. During freewheeling, the bolt 4 and lock swing catch 5 are not moved and consequently the lock remains locked.

Figure 5:
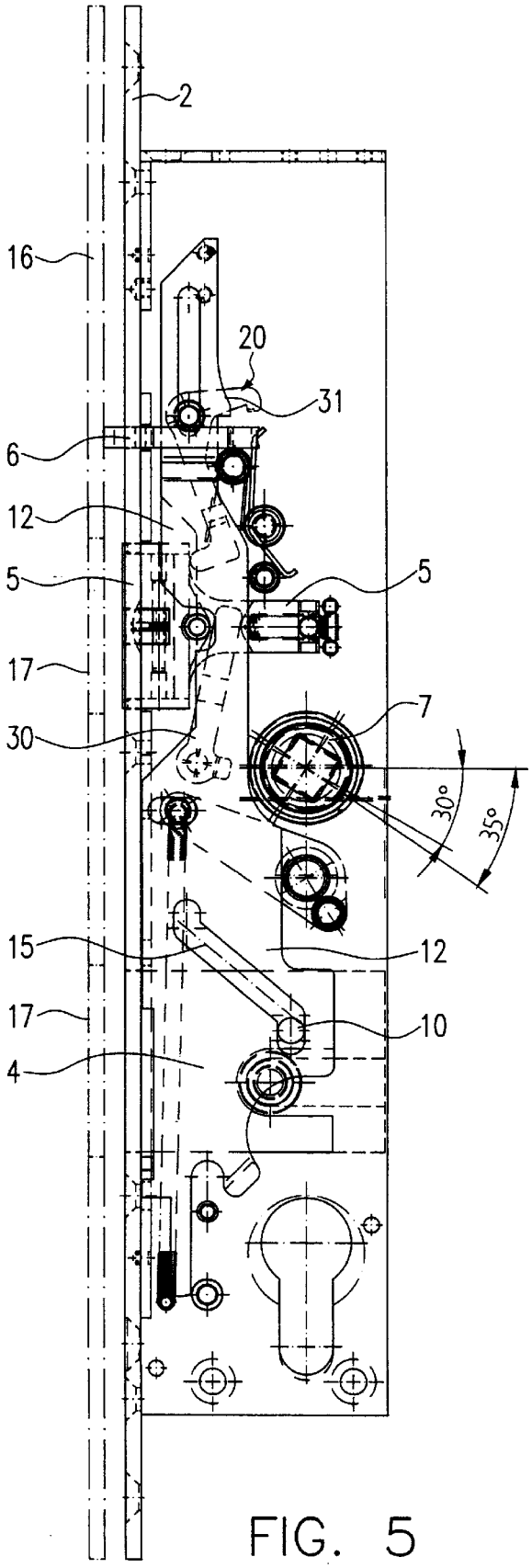

FIG. 5 shows the lock on operation from the outside with authorized access, e.g., with an access control system. In this case, e.g., the door latch or latch nut 7 can be electrically coupled by a lifting magnet with the door latch on the inside (not shown). Through the coupling, the bolt 4 and lock swing catch 5 are retracted via the panic side by turning the outside door latch (FIG. 2) and the door can be opened.

Figure 6:
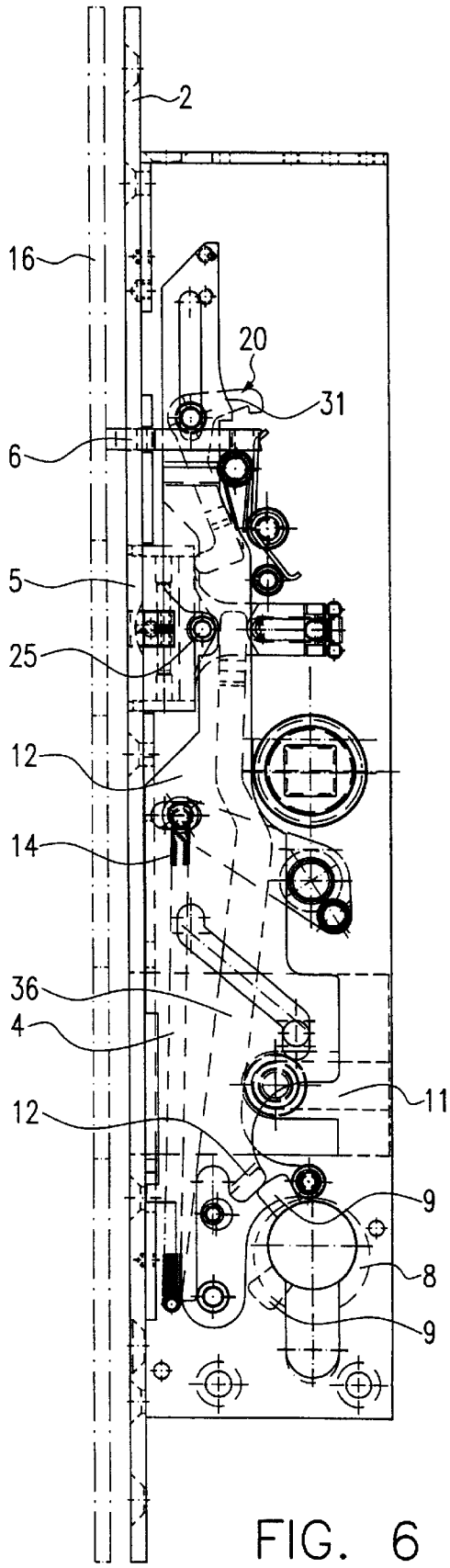

FIG. 6 shows an operation of the lock with a key-operable locking system 8. By turning the locking system 8 with the closing nose 9, the bolt 4 is retracted by means of the slide plate 12 and the lock swing catch 5 is retracted by means of a changer 36, so that the door can be opened.

Figure 7:
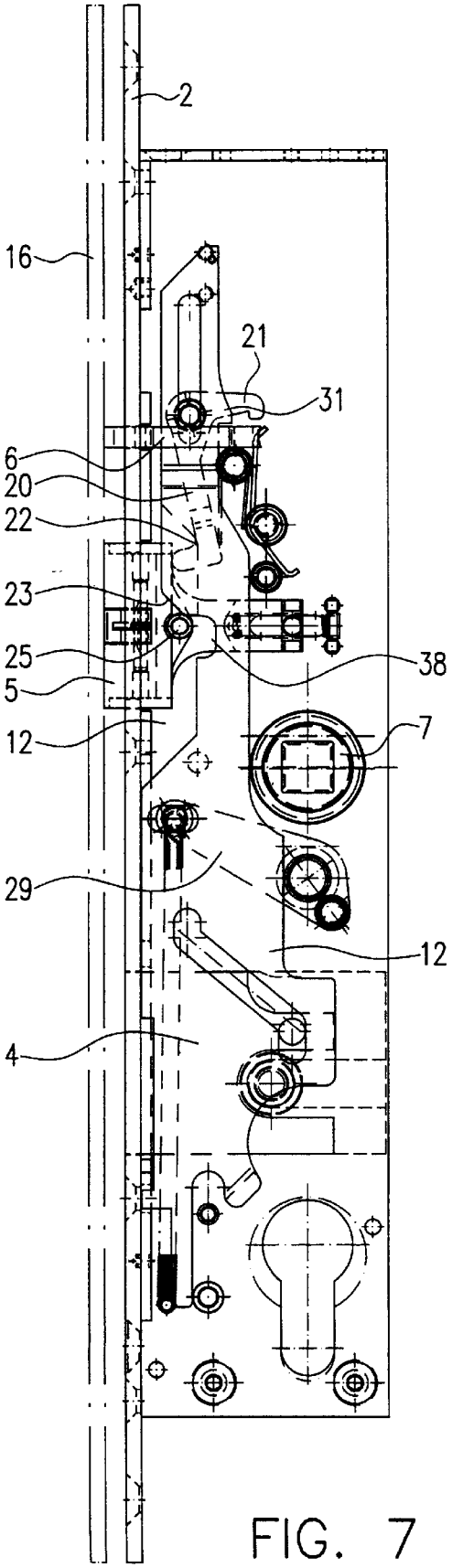
FIG. 7 is a cross-section through the lock according to FIGS. 1 to 6 in an intermediate state of opening or closing a door, FIGS. 8.1 to 8.3 are plan views of a lock according to FIG. 7, showing the lock swing catch and auxiliary swing catch on opening a door.

FIG. 7 shows an intermediate state of the lock according to FIGS. 1 to 6 on opening and closing a door, said intermediate state being reached by means of the lock swing catch 5 with catch part 40 shown in FIGS. 8.1 to 11, and with roller 25 and the clearly defined arrangement of the lock swing catch 5 relative to the auxiliary swing catch 6 and the slide plate 12. The lock swing catch 5 there slides on the front of the locking plate 16 and so cannot move further outward. The slide plate 12 is held by the roller 25 of the lock swing catch 5 and, in the position of FIG. 4, prevents further downward movement of the slide plate 12, and so simultaneously holds the bolt 4 in the retracted position. Thus, an unintentional moving forward of the bolt 4 into a locking position is impossible.

FIGS. 8.1 to 8.3 show a plan view of a lock according to FIG. 7, a process of opening a door in the vicinity of the lock swing catch 5 with catch part 40 and an auxiliary swing catch 6. An arrow A indicates the opening direction of a door. As described in conjunction with FIGS. 2, 5 or 6, the bolt 4 and lock swing catch 5 are retracted. If the door is opened somewhat and the door latch released again, as a result of the catch part 40, the lock swing catch 5 can only move in a locking direction up to the surface of the locking plate 16 (FIG. 8.1). The slide plate 12 is then held by the roller 25 of the lock swing catch 5 at the bevel 23, and so the bolt 4 remains in the retracted position in the lock (FIG. 7). If the door is further opened (FIG. 8.2), the auxiliary swing catch 6 initially moves forward and intercepts the slide plate 12 and consequently also the bolt 4 (FIG. 3). Then the lock swing catch 5 also moves forward (FIG. 8.3) and the state shown in FIG. 3 is reached. The lead of the auxiliary swing catch 6 compared with the lock swing catch 5 or the lag of the latter with respect to the auxiliary swing catch 5 is brought about by the widening of the spring-loaded swing catch part 40 of the lock swing catch 5 (see also FIGS. 10 and 11).

During a door closing movement (FIGS. 9.1 to 9.3 with the closing direction according to arrow B), the swing catch part 40 is initially pressed back by an edge of a locking plate 16, which is dependent on the door gap, which can be approximately 4 to 1 mm (FIG. 9. 1). FIGS. 9.1 and 9.2 make it clear that the catch part 40 is not effective, because it is pivoted and received by the lock swing catch 5. The auxiliary swing catch 6, which also engages on the edge of the locking plate 16 (FIG. 9.2), then releases the slide plate 12. However, the slide plate 12 is retained by the roller 25 (FIG. 7) until the lock swing catch 5 can move forward in a locking position in the locking plate (FIG. 9.3). The bolt 5 can then also move forward into a locking position. The locking state according to FIG. 1 is then reached.

Figure 10:
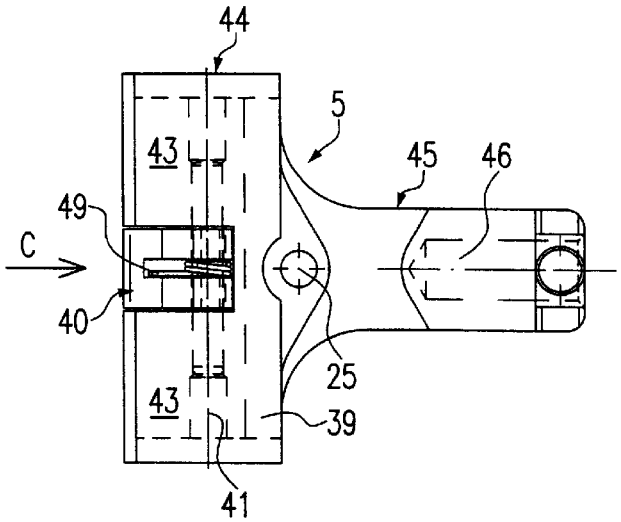
FIG. 10 is a view of an inventively constructed lock swing catch.
Figure 11:
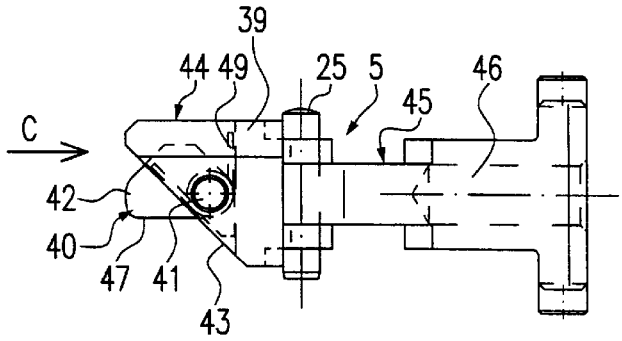
FIG. 11 is a plan view of an inventive lock swing catch according to FIG. 10.

The lock swing catch 5 according to FIGS. 8 and 9 is shown on a larger scale and without the auxiliary swing catch in FIGS. 10 and 11. The lock swing catch 5 comprises a body 39 and has for widening purposes a pivotable swing catch part 40, which is so counterloaded that on closing the door and pressing on a locking plate 16 (FIG. 9.1) the catch part 40 is pivoted into and received by the body 39. On opening the door, the spring-loaded swing catch part 40 pivots to the position of FIG. 11, thereby widening the body 39 (FIGS. 8.1 to 8.3) and thereby produces a longer engagement on the locking plate 16 and the cooperation of the roller 25 with the slide plate 12 (FIG. 7).

The swing catch part 40 is in the present embodiment pivotable about a vertical axis 41 and widens the lock swing catch 5 on the face plate side with a projecting area 42 projecting over a wedge surface 43 of the body 39. The lock swing catch 5 has the roller of catch bushing 25 in the transition between a swing catch area 44 which can be moved out in a locking position and a swing catch area 45 guided in the lock housing 3 and which is provided with a spring receptacle 46 for a compression spring 48 (e.g. FIG. 1). The slide plate 12 is held on said roller 25 with its control edge 24 (FIG. 1) or bevel 23 (FIG. 7), in order to prevent a vertical movement of the slide plate 12 and so an undesired moving forward in a locking position of the bolt 4 and prevent damage and interference on the lock.

The pivotable swing catch part 40 is constructed cross-sectionally as an isosceles triangle with rounded angles or corners and is subject to the action of a spring clip 49 mounted on the cylinder pin 41. The spring catch part 40 in the unloaded state projects over the wedge surface 43 due to the action of the spring clip 49 and widens the lock swing catch 5, so that on closing of the door its retraction leads compared with the auxiliary swing catch 6 (FIGS. 9.1 to 9.3). On opening the door, on the other hand, the auxiliary swing catch 6 leads the lock swing catch 5 in such a way that the widened lock swing catch 5 engages the locking plate 16 longer than the auxiliary swing catch 6, since the swing catch part 40 is held in projecting, unpivoted manner by the spring clip 49. The swing catch part 40, considered in the longitudinal direction, is arranged roughly centrally in the body and is completely received by the said body 39 on pivoting about the cylinder pin 41, which is guided in an angle region adjacent to the base surface 47. The base surface 47 is then aligned with an upper and a lower area of the wedge surface 43 of the front swing catch area 44 moving out in a locking position.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A self-locking lock for a door, comprising:

a bolt which is spring biased into an advanced locking position;

a slide plate movable to a position in which the slide plate arrests the bolt in a retracted position;

an auxiliary swing catch which releases the arrest of the bolt when the door is fully closed; and a lock swing catch spring biased into an advanced locking position and cooperable with the slide plate for retaining the slide plate in a position to arrest the bolt in a retracted position, wherein the lock swing catch has a catch bushing or roller cooperating with the slide plate and on which movement of the slide plate can be arrested, wherein the lock swing catch includes a swing catch part mounted thereon and movable between a retracted position in which the swing catch part fits within the lock swing catch and an advanced position in which the swing catch part widens the lock swing catch, and means for causing the bolt to lead compared with the lock swing catch and the lock swing catch to lag behind the auxiliary swing catch on opening the door, so that the slide plate and bolt are arrested by the lock swing catch until the auxiliary swing catch arrests the slide plate and the bolt.

2. Lock according to claim 1, wherein the swing catch part is arranged pivotably on a body of the lock swing catch.

3. Lock according to claim 2, wherein the body of the lock swing catch has a swing catch area which can be moved into a locking position from a lock housing and another swing catch area guided in the lock housing, and wherein the roller of the lock swing catch is positioned in a transition area between the swing catch areas.

4. Lock according to claim 3, wherein the swing catch part, in the longitudinal direction, is positioned roughly centrally in the swing catch area of the body, wherein the swing catch is pivotable about a vertical axis counter to the tension of a spring, and wherein the swing catch part pivots on closing the door and is received by the body, while on opening of the door the swing catch part moves to the widening position and ensures an engagement of the slide plate on the roller of the lock swing catch.

5. Lock according to claim 4, wherein the swing catch part is cross-sectionally constructed as an isosceles triangle with rounded angles, is subject to the action of a spring clip which is mounted on a cylinder pin forming a pivot pin, and wherein the swing catch part in an unloaded state projects by the tension of the spring clip over a wedge surface of the spring clip area to widen the lock swing catch.

6. Lock according to claim 5, wherein on opening the door, the auxiliary swing catch leads compared with the lock swing catch, so that the latter is widened and engages on a locking plate of the door so that the bolt remains in the retracted position in the lock, wherein the slide plate is then arrested on a bevel of the roller of the lock swing catch engaging on the locking plate and keeps the slide plate in an arrested position.

7. Lock according to claim 6, wherein the swing catch part of the lock swing catch on pivoting the door and engaging on the locking plate pivots and is received by the lock swing catch, wherein the auxiliary swing catch engages after the lock swing catch on the locking plate, releases the slide plate from a stop position and the slide plate is arrested by the roller of the lock swing catch and is vertically movable when the lock swing catch moves forward in a locking position in the locking plate.

8. Lock according to claim 1, wherein the bolt is moved by a link-like guide from a position completely retracted into a lock housing into a forward locking position and wherein the slide plate, which extends from a lower housing edge to above the auxiliary swing catch, is guided in a recess of the auxiliary swing catch and is provided a recess and a bevel, as well as a vertical control edge which can be engaged with the roller of the lock swing catch.

9. Lock according to claim 1, wherein the lock swing catch is movable by means of a catch lever by a coupleable inner/outer latch nut and a mechanism, as well as by a key-operable lock cylinder and a changer.

10. Locking according to claim 1, wherein when the door is opened, the auxiliary swing catch and lock swing catch project from a lock housing and the bolt is completely retracted into the lock housing, the bolt is secured against unintentional release by the auxiliary swing catch, the auxiliary swing catch being blocked by a catch lever and the slide plate being arrested on a detent.

11. Lock according to claim 10, wherein by a relative movement of the locking swing catch and auxiliary swing catch, the latter is unlocked and the bolt moves forward in a self-locking manner into a locking position by means of the slide plate.

* * * * *